United States Patent [19]

Williams et al.

[11] Patent Number: 4,572,226

[45] Date of Patent: Feb. 25, 1986

[54] PUSH BUTTON AUTOMATIC OPEN AND CLOSE UMBRELLA

[76] Inventors: Gery R. Williams; George Spector, both of 233 Broadway, Rm. 3615, New York, N.Y. 10007

[21] Appl. No.: 639,225

[22] Filed: Aug. 9, 1984

[51] Int. Cl.[4] ..... A45B 25/16

[52] U.S. Cl. ..... 135/22; 135/20 M; 74/89.15; 74/424.8 A

[58] Field of Search ..... 135/22, 23, 24, 20 M, 135/43; 74/424.8 A, 89.15, 424.8 R

[56] References Cited

U.S. PATENT DOCUMENTS

| | | | |
|---|---|---|---|
| 1,590,570 | 6/1926 | Flack et al. | 74/89.15 |
| 1,678,731 | 7/1928 | Klauset | 74/424.8 A |
| 3,129,715 | 4/1964 | Militano et al. | 135/20 M |
| 3,856,030 | 12/1974 | Sato | 135/22 |
| 4,421,133 | 12/1983 | Huang | 135/22 |
| 4,424,824 | 1/1984 | Becher | 135/20 M |

*Primary Examiner*—Robert A. Hafer
*Assistant Examiner*—Daniel Nolan

[57] ABSTRACT

A push button automatic open and close umbrella of the type having a hollow tubular post, an umbrella top, a runner slideably engaging the post for movement of the top into open and closed positions with respect to the post and a handle at bottom of the post is provided and consists of a miniature forward and reverse drive motor mounted in the handle, a drive mechanism within the post activated by the motor to operate the runner and a manual override device to disengage the drive mechanism to manually operate the runner. In another form the umbrella can be collapsible.

5 Claims, 4 Drawing Figures

PUSH BUTTON AUTOMATIC OPEN AND CLOSE UMBRELLA

BACKGROUND OF THE INVENTION

The instant invention relates generally to umbrellas and more specifically it relates to a push button automatic open and close umbrella.

Numerous umbrellas have been provided in prior art that are adapted to be operated into opened and closed positions. For example U.S. Pat. Nos. 2,960,094; 3,756,258 and 3,856,030 all are illustrative of such prior art. While these units may be suitable for the particular purpose to which they address, they would not be suitable for the purposes of the present invention as heretofore described.

SUMMARY OF THE INVENTION

A principle object of the present invention is to provide a push button automatic open and close umbrella that has a miniature motor in the handle that activates a drive mechanism to operate the umbrella.

Another object is to provide a push button automatic open and close umbrella that has a manual override feature to disengage the drive mechanism to manually operate the umbrella.

An additional object is to provide a push button automatic open and close umbrella that encorporates the miniature motor, drive mechanism and the manual override feature in standard and collapsible umbrella types.

A further object is to provide a push button automatic open and close umbrella that is simple and easy to use.

A still further object is to provide a push button automatic open and close umbrella that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
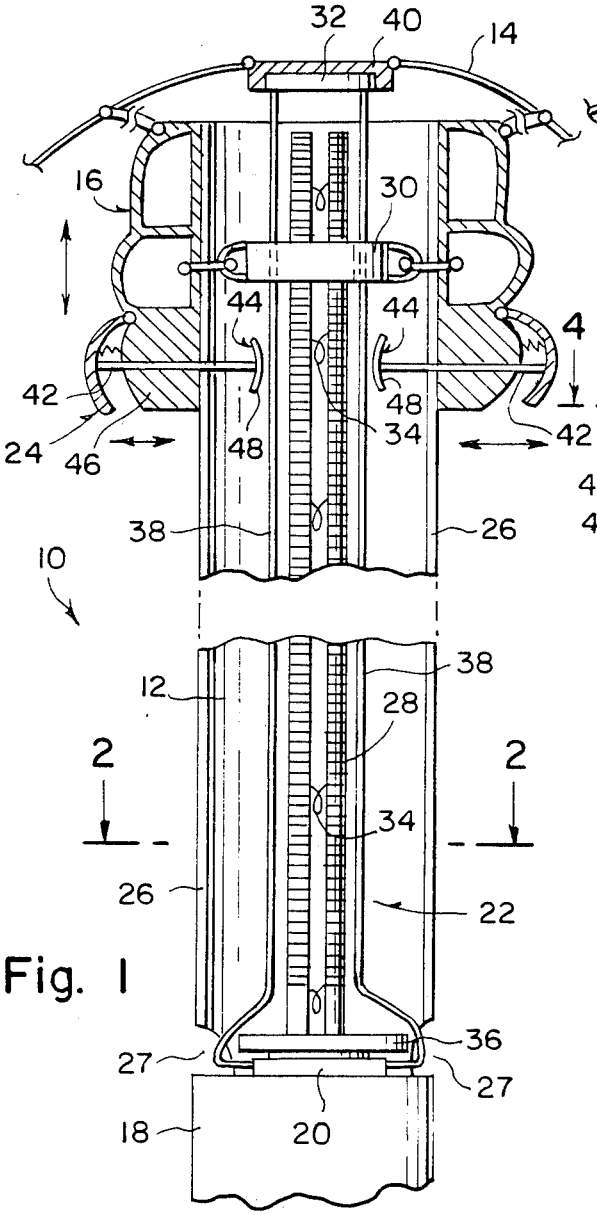
FIG. 1 is a longitudinal side view partly in section of one embodiment of the invention.
Figure 2:
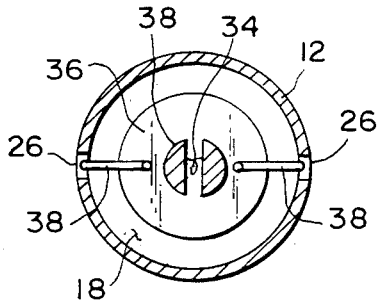
FIG. 2 is a cross sectional view taken along line 2—2 in FIG. 1.

Turning now descriptively to the drawings, in which similar reference characters denote similar elements throughout the several views, FIGS. 1 and 2 illustrates a push button automatic open and close umbrella 10 of the type that has a hollow tubular post 12, an umbrella top 14, a runner 16 slideably engaging the post 12 for movement of the top 14 into open and closed positions with respect to the post 12 and a handle 18 at bottom of the post 12.

The invention of the umbrella 10 consists of a miniature forward and reverse drive motor 20 mounted in the handle 18, a drive mechanism 22 within the post 12 activated by the motor 20 to operate the runner 16 and a manual override device 24 to disengage the drive mechanism 22 to manually operate the runner 16.

The post has two longitudinal opposite slots 26 therein and the drive mechanism 22 consists of a longitudinal split threaded shaft 28, a drum 30 and a bearing 32.

The shaft 28 is spring biased at 34 and is mounted stationary to the handle 18 at plate 36. The drum 30 has internal threads engagable to the shaft 28. The drum is interconnected to the runner 16 through the slots 26 in the post 12. The bearing 32 has two thin rods 38 and is mounted to center 40 of the umbrella top 14 while the rods 38 extend through the drum 30 to the motor 20 so that the motor via the rods can rotate the drum along the shaft 28 to operate the runner 16.

The manual override device 24 consists of two spring biased arms 42 that have contact member 44. The arms are mounted to lower portion 46 of the runner 16. The arms 42 can be manually activated to slideably extend through the slots 26 in the post 12 with the contact members 44 compressing the shaft 28, disengaging the drum 30, allowing manual operation of the runner 16. Each contact member 44 is a curved plate 48 so that the curved plate can move along the shaft 28 without engaging the threads thereon.

Figure 3:
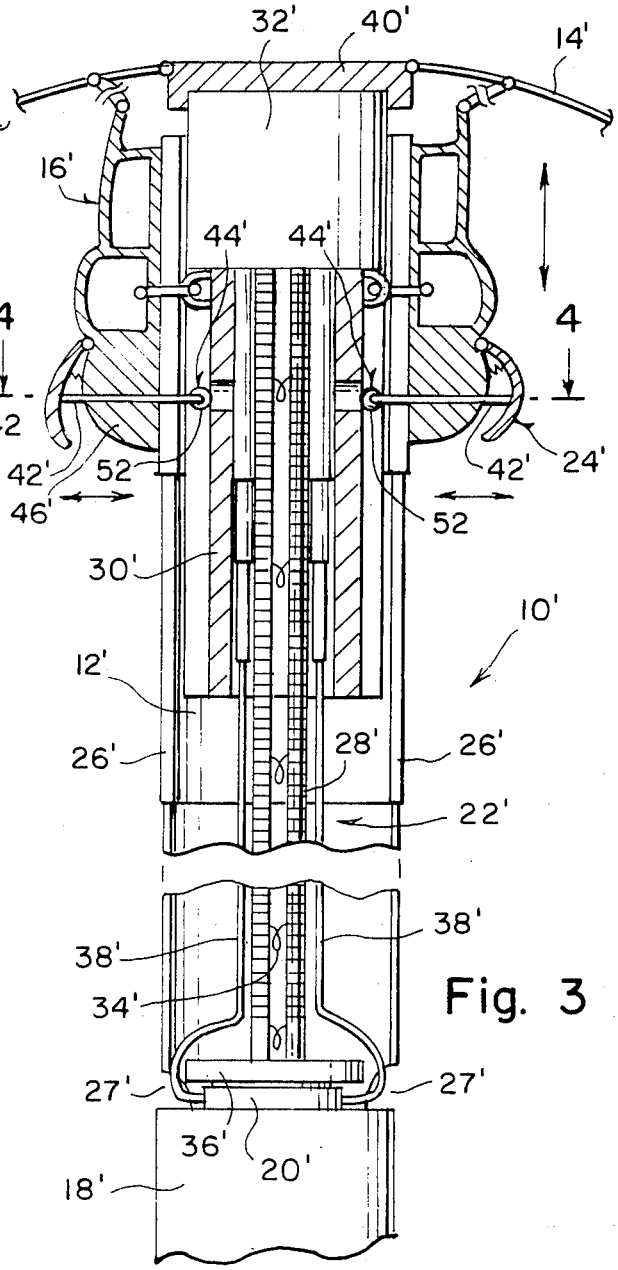
FIG. 3 is a longitudinal side view partly in section of another embodiment of the invention.
Figure 4:
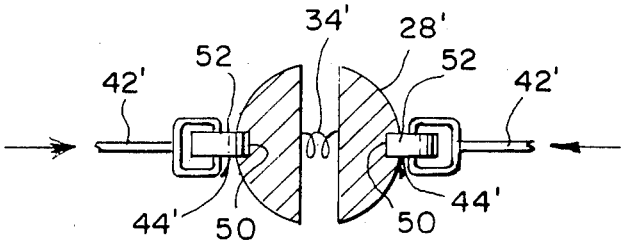
FIG. 4 is an enlarged partial cross sectional view taken along line 4—4 in FIG. 3 of the compression rollers in engagement with the split threaded post.

As shown in FIGS. 3 and 4 each half of the split shaft 28' has a longitudinal recessed groove 50 therein and the contact member 44' is a roller 52 so that each roller can move along the groove 50 within the shaft 28' without engaging the threads thereon. Split shaft 28' threadably engages drums 30' similar to the corresponding parts of FIG. 1.

The push button automatic open and close umbrella 10' as shown in FIG. 3 is collapsible wherein the post 12' and the rods 38' are each formed of a plurality of telescopic sections. The collapsible umbrella 10' works on the same principle as the regular umbrella 10 of FIG. 1 with all other parts basically the same except for telescopic feature. Telescoping is manually effected by disengagement of shaft 28', when arms 42' are inwardly pressed and override device 24 is moved axially downward.

Open areas 27 at bottom of slots 26 in post 12 are provided for manually adjusting or turning the rods 38 so as not to block the arms 42 if manual operation is required for umbrella 10'. The open areas 27' at bottom of slots 26' in post 12' are also provided for manually adjusting or turning the rods 38' so as not to block the arms 42' if manual operation is required for umbrella 10' or collapsing is to be effected. Bearing 32' telescopes on drum 30' and shaft 28' to allow center 40' to move downward towards the handle for collapsing purposes.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a push button automatic open and close umbrella of the type having a hollow tubular post, an umbrella top, a runner slideably engaging said post for movement of said top into open and closed positions with respect to said post and a handle at bottom of said post the improvement which comprises:

(a) a miniature forward and reverse drive motor mounted in said handle;

(b) a drive mechanism within said post activated by said motor to operate said runner; and (c) a manual override device to disengage said drive mechanism to manually operate said runner, wherein said post has two longitudinal opposite slots therein and said drive mechanism comprises:

(a) a longitudinal split threaded shaft that is spring biased, said shaft mounted stationary to said handle;

(b) a drum having internal threads engageable to said shaft, said drum interconnected to said runner through said slots in said post; and (c) a bearing having a plurality of thin rods, said bearing mounted to center of said umbrella top while said rods extend through said drum to said motor so that motor rotation will rotate said rods which will cause drum rotation and axial movement of said drum on said shaft to operate said runner.

2. A push button automatic open and close umbrella as recited in claim 1, wherein said manual override device comprises a plurality of spring biased arms having contact members, said arms mounted to lower portion of said runner so that said arms can be manually activated to slideably extend through said slots in said post with said contact members compressing said shaft, disengaging said drum allowing manual operation of said runner.

3. A push button automatic open and close umbrella as recited in claim 2, wherein each said contact member is a curved plate so that said curved plate can move along said shaft without engaging said threads thereon.

4. A push button automatic open and close umbrella as recited in claim 3, wherein each half of said split shaft has a longitudinal recessed groove therein and said contact member is a roller so that each said roller can move along said groove within said shaft without engaging said threads thereon.

5. A push button automatic open and close umbrella as recited in claim 2, wherein said post, said rods are each formed of a plurality of telescopic sections, and longitudinally wherein said bearing is longitudinally slideably mounted on said drum and shaft for collapsing purposes.

* * * * *